US009220159B2

(12) United States Patent
Rooijackers et al.

(10) Patent No.: US 9,220,159 B2
(45) Date of Patent: Dec. 22, 2015

(54) ELECTRONIC BALLAST

(75) Inventors: Cornelis Josef Petrus Maria Rooijackers, Waalre (NL); Wilhelmus Hinderikus Maria Langeslag, Wychen (NL)

(73) Assignee: NXP B.V., Eindhoven (NL)

( * ) Notice: Subject to any disclaimer, the term of this patent is extended or adjusted under 35 U.S.C. 154(b) by 987 days.

(21) Appl. No.: 13/366,861

(22) Filed: Feb. 6, 2012

(65) Prior Publication Data

US 2013/0033177 A1 Feb. 7, 2013

(30) Foreign Application Priority Data

Feb. 15, 2011 (EP) ..... 11154493

(51) Int. Cl.
*H01J 1/52* (2006.01)
*H05B 41/28* (2006.01)

(52) U.S. Cl.
CPC ..... *H05B 41/28* (2013.01)

(58) Field of Classification Search
CPC ... H05B 41/28; H05B 41/282; H05B 41/2827
See application file for complete search history.

(56) References Cited

U.S. PATENT DOCUMENTS

| | | | | |
|---|---|---|---|---|
| 5,995,398 | A | 11/1999 | Yamauchi et al. | |
| 6,051,936 | A | 4/2000 | Qian | |
| 2003/0071582 | A1 | 4/2003 | Zhang et al. | |
| 2005/0269972 | A1 * | 12/2005 | Trestman et al. | 315/294 |
| 2008/0211417 | A1 | 9/2008 | Foo | |
| 2011/0006700 | A1 * | 1/2011 | Chen et al. | 315/283 |
| 2012/0104965 | A1 * | 5/2012 | Gergely et al. | 315/291 |

FOREIGN PATENT DOCUMENTS

| | | | |
|---|---|---|---|
| WO | 98/46050 | A1 | 10/1998 |
| WO | 00/40060 | A1 | 7/2000 |
| WO | 2004/028218 | A1 | 4/2004 |

OTHER PUBLICATIONS

Extended European Search Report for European Patent Appln. 11154493.8, 7 pgs. (Apr. 20, 2011).

* cited by examiner

*Primary Examiner* — Sibin Chen

(57) ABSTRACT

An electronic ballast for lighting applications is disclosed. The electronic ballast comprises a first charge pump having an input capacitor (13) charged with a supply current drawn from a power source by application of a charging voltage to the input capacitor (13), the magnitude of the supply current being proportional to the magnitude of the charging voltage; and a voltage booster (16, 17) for generating a boost voltage, which is used to augment the charging voltage, thereby increasing the current drawn from the power source.

11 Claims, 12 Drawing Sheets

ELECTRONIC BALLAST

CROSS-REFERENCE TO RELATED APPLICATIONS

This application claims the priority under 35 U.S.C. §119 of European patent application no. 11154493.8, filed on Feb. 15, 2011, the contents of which are incorporated by reference herein.

The invention relates to an electronic ballast for lighting applications, and to a method for controlling current drawn by an electronic ballast for lighting applications from a power source.

Dimming of electric lighting, in particular domestic lighting, is typically performed by a TRIAC-based controller, which is usually mounted in place of an ordinary light switch. The TRIAC-based controller allows a user to select the level of illumination required by adjustment of a control.

A TRIAC-based dimmer operates by conducting over only a part of the alternating current mains cycle, which is known as phase angle control. During a positive half-cycle, the TRIAC is triggered by a timing circuit in the dimmer, which can be adjusted by a user. The TRIAC continues to conduct until the current flowing through the TRIAC falls below a holding current, typically in the range of 10 to 30 mA. The TRIAC is then ready to be triggered again by the timing circuit during the negative half-cycle. Other dimmers are based on field-effect transistors (FETs) and these also require a continuous holding current to flow through them to maintain conduction.

TRIACs work particularly well in dimming conventional incandescent lamps, which are linear resistive loads because the AC mains current and voltage will remain in phase. This ensures that the current flowing through the TRIAC falls below the holding current very nearly at the end of each half-cycle. Thus, the TRIAC can accurately cut off part of the leading edge of each half-cycle and maintain conduction for the remainder of the half-cycle to allow a desired amount of power to reach the lamp.

On the other hand, with non-linear loads it is possible that the current flowing through the TRIAC will fall below the holding current prematurely or not at all. One such non-linear load is a compact fluorescent lamp (CFL). These offer a much higher lifespan and efficiency than conventional incandescent lamps, but they do not work well with dimmers as the electronic ballast used with CFLs does not draw a current from the mains that is higher than the holding current continuously over a half-cycle; instead the current is drawn in spikes. This leads to flickering (typically at the lower dimmer settings) and multiple firing (typically at the higher dimmer settings), which can cause buzzing and even damage to the dimmer. Despite the benefits mentioned above that CFLs present, their uptake has been affected by this problem as consumers wish to be able to dim the lights in various areas of a house, such as bedrooms and living rooms.

There have been various attempts to overcome this problem. One way is to incorporate full power factor correction into the ballast. However, this is complicated and costly. Furthermore, it requires larger components to handle the increased power, and this is incompatible with the requirement to house the electronic ballast in the lamp base or a luminaire.

US2008/0211417 discloses a dimmable ballast, which measures the conduction angle of the dimmer and adjusts the switching frequency of the lamp to ensure that the power factor and luminous intensity of the lamp are in accordance with the conduction angle. This is however, a complicated arrangement.

WO98/46050 discloses another complicated arrangement, in which a power feedback circuit is used to ensure that sufficient current is drawn from the dimmer to maintain conduction of a TRIAC.

Other ballasts use a charge pump, which uses the lamp voltage swing to pump current from the AC mains to an electrolytic storage capacitor in the ballast. An inverter in the ballast uses the energy stored in the storage capacitor to generate high voltage AC to drive the CFL. With these charge pump circuits, the current drawn from the dimmer is given by the following equation:

$$|i_{in}|=C_{in}f_s(|v_{in}|+2V_a-V_B)$$

where:

$i_{in}$ is the current drawn from the dimmer $C_{in}$ is the charge pump input capacitor $f_s$ is the switching frequency (typically 40 to 70 kHz)

$v_{in}$ is the mains voltage $V_a$ is the peak lamp voltage $V_B$ is the voltage across the electrolytic storage capacitor As can be seen, from this equation the current drawn is dependent on the peak lamp voltage and the voltage across the electrolytic storage capacitor, and it is possible for this to fall below the holding current and even to zero (if the lamp voltage is less than half the voltage across the electrolytic storage capacitor) irrespective of the switching frequency and value of the input capacitor. The problems mentioned above (i.e. buzzing and flickering) can therefore be manifest in the charge pump style of ballast as well, especially at low dimming levels.

Furthermore, the current drawn from the mains will fall below the holding current of a TRIAC if the value of the charge pump input capacitor is too low. Using a larger capacitor could solve this problem (albeit with additional expense and bulk), but introduces another problem. That is that the resonant frequency of the inverter in the ballast changes when the TRIAC switches on and off (because the resonant frequency is a function of the mains voltage; thus when the TRIAC turns on the mains voltage and resonant frequency change rapidly). This change in resonant frequency is greater if the value of the charge pump input capacitor is increased. The change is even more pronounced in 230V applications since the charge pump input capacitor typically has a similar value to the resonant capacitor across the lamp in the inverter.

To maintain an even brightness and a constant charge pump function, it is necessary for the feedback control of the inverter to respond rapidly to this change of resonant frequency. However, it is difficult to design a feedback control circuit for the inverter that can maintain adequate operation at deep dimming levels and cope with the large signal frequency changes (which can be higher than 10 kHz) as the TRIAC turns on and off.

According to the invention, there is provided an electronic ballast for lighting applications, the electronic ballast comprising a first charge pump having an input capacitor charged with a supply current drawn from a power source by application of a charging voltage to the input capacitor, the magnitude of the supply current being proportional to the magnitude of the charging voltage; and a voltage booster for generating a boost voltage, which is used to augment the charging voltage, thereby increasing the current drawn from the power source.

Hence, by augmenting the charging voltage for the input capacitor, the current drawn from the power source is increased and the conduction of a TRIAC in a dimmer will be maintained as desired. The problems of flickering and buzzing mentioned above are therefore overcome. It is also possible to reduce the size of the input capacitor, which means the resonant frequency change in the inverter is reduced and the feedback network can be designed more easily as the small signal requirements dominate.

The power source is typically an AC power source, such as a 120V or 230V mains power source. In some countries, 100V or 200V mains power sources are used.

Typically, the electronic ballast is coupled to the power source by a bridge rectifier, which produces a supply voltage for the electronic ballast.

In one embodiment, a first terminal of the input capacitor is coupled to the bridge rectifier such that the charging voltage increases with the supply voltage.

The first terminal of the input capacitor is normally coupled to the bridge rectifier via one or more diodes as will be explained in detail below.

The electronic ballast preferably further comprises an electromagnetic interference (EMI) filter coupling the power source to the bridge rectifier.

The EMI filter may comprise a pair of filter capacitors in series between input terminals of the bridge rectifier, and a first terminal of the input capacitor may be coupled to the junction of the filter capacitors.

The input capacitor of the first charge pump is normally coupled via a diode to a reservoir capacitor. The input capacitor pumps current from the power source to the reservoir capacitor. The structure of the first charge pump will be explained in detail below.

Typically, a second terminal of the input capacitor is coupled to a source of alternating voltage generated within the ballast. In some embodiment, this source of alternating voltage is generated for driving a lamp. Thus, the lamp voltage may be used to drive the charge pump, or in other words to cause the input capacitor to pump current from the power source to the reservoir capacitor. The alternating voltage is typically oscillating at high frequency.

Preferably, the source of alternating voltage is an inverter. The inverter will usually have a resonant circuit driven by a pair of electronic switches in a half-bridge arrangement, the pair of electronic switches switching alternately. The pair of electronic switches may be coupled across the reservoir capacitor mentioned above, which then provides a source of DC for the inverter. The rapid switching of the electronic switches causes the resonant circuit to oscillate. Typically, the resonant circuit comprises a coil and capacitor in series, the source of alternating voltage being at the junction of the coil and capacitor.

In a preferred embodiment, the lamp comprises a compact fluorescent lamp (CFL) or an assembly of LEDs in series.

However, the invention may be used with other types of gas discharge lamp, such as fluorescent tube lights.

If an assembly of LEDs in series is used as the lamp then they are usually coupled to the ballast by way of a bridge rectifier. This will rectify the AC from the source of alternating voltage to produce a DC voltage for the LEDs. The bridge rectifier may be isolated from the source of alternating voltage by way of a transformer.

In one embodiment, the voltage booster comprises a secondary winding of a transformer that generates the boost voltage.

Preferably, the primary winding of the transformer is driven by the source of alternating voltage. To achieve this, the primary winding may either be the coil in the resonant circuit or a separate coil coupled from the source of alternating voltage to a ground terminal.

The second terminal of the input capacitor may be coupled to the source of alternating voltage via the secondary winding of the transformer, the primary winding being driven by the alternating voltage. In this case, the secondary winding may be coupled directly to the transformer or via another secondary winding of the transformer, such as one used to energise a lamp. In this case, the boost voltage is used to increase the voltage at the second terminal to increase the charging voltage.

In another embodiment, the electronic ballast further comprises a second charge pump adapted to increase the voltage at a first terminal of the input capacitor. This therefore increases the charging potential. The second charge pump typically comprises a second charge pump input capacitor that couples the boost voltage to one of many points in the electronic ballast suitable to raise the voltage at the first terminal of the input capacitor. These points will be explained in detail below.

Typically, however, the second charge pump input capacitor will be coupled to the bridge rectifier, via one or more diodes. It may be coupled to a second reservoir capacitor through a diode. The second charge pump capacitor preferably is coupled to the secondary winding of the transformer that generates the boost voltage.

In another aspect of the invention, there is provided a method for controlling current drawn by an electronic ballast for lighting applications from a power source, the method comprising charging an input capacitor in a first charge pump with a supply current drawn from a power source by application of a charging voltage to the input capacitor, the magnitude of the supply current being proportional to the magnitude of the charging voltage; and generating a boost voltage, which is used to augment the charging voltage, thereby increasing the current drawn from the power source.

The boost voltage is preferably generated by a secondary winding of a transformer, the primary winding of which is energised by a source of alternating voltage generated within the electronic ballast for driving a lamp.

The boost voltage may be used to augment the charging voltage by increasing the voltage at either a first or a second terminal of the input capacitor.

Examples of the invention will now be described in detail with reference to the accompanying drawings, in which.

Figure 1:
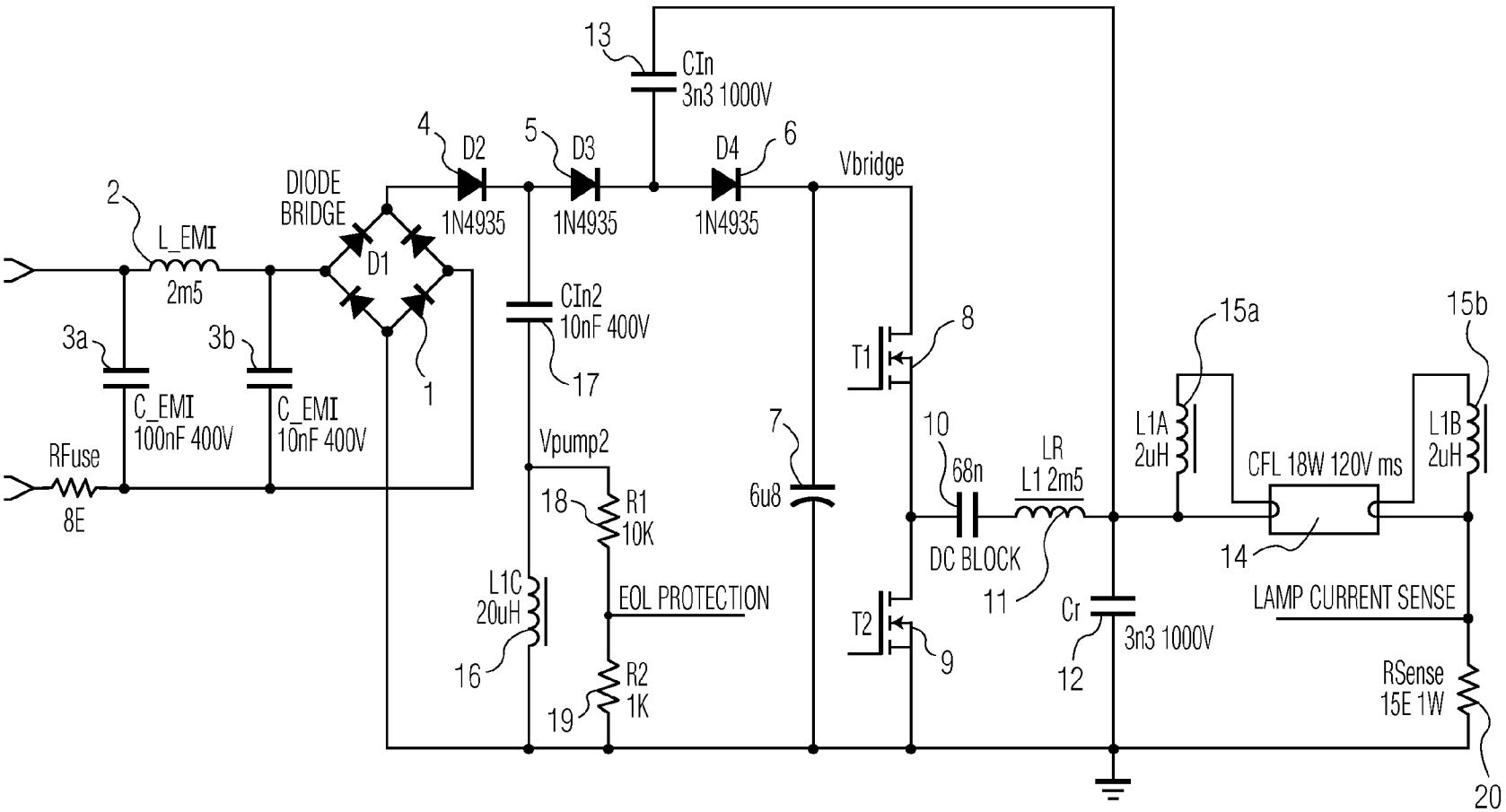
FIG. 1 shows a circuit diagram of a first embodiment of an electronic ballast according to the invention.

In the first embodiment, shown in FIG. 1, a bridge rectifier 1 receives A.C. mains voltage via a filter formed of inductor 2 and capacitors 3*a*, 3*b*. This filter serves the purpose of preventing conduction of electromagnetic interference into and out of the electronic ballast. The bridge rectifier 1 rectifies the A.C. main voltage and couples it via three diodes 4, 5, 6 to a reservoir capacitor 7.

In parallel with capacitor 7, there are two series transistor switches 8, 9, which are arranged to switch alternately at a high frequency (typically 40 to 70 kHz). A D.C. blocking capacitor 10 couples the junction between these transistor switches 8, 9 to a resonant circuit made up of an inductor 11 and a capacitor 12. The inductor 11 is the primary winding in a transformer.

The junction between inductor 11 and capacitor 12 is coupled to the junction between diodes 5, 6 by a charge pump input capacitor 13. It is also coupled to a terminal of a compact fluorescent lamp 14. Two secondary windings 15*a*, 15*b* generate the voltage required to illuminate lamp 14. The resistor 20 is used to monitor the current flowing through the lamp and is not directly relevant to this invention.

A third secondary winding 16 generates a boost voltage to augment the voltage received from the bridge rectifier via diode 4. The boost voltage is coupled to the junction between diodes 4, 5 by charge pump capacitor 17. The third secondary winding 16 and capacitor form a second charge pump that acts as an input voltage booster. The resistors 18, 19 across the third secondary winding 16 are used to monitor for an end-of-life condition and are not directly relevant to this invention. The use of a second charge pump also reduces ringing in the EMI filter formed from coil 2 and capacitors 3*a*, 3*b*. This ringing can occur if the peak mains voltage is almost equal to the voltage across reservoir capacitor 7. In this case, diodes 4, 5 and 6 will cease to conduct, leading to ringing in the EMI filter due to the energy stored in it. This ringing can cause the current drawn through the TRIAC to drop below the hold current. However, the second charge pump prevents this by continuing to draw a small current from the mains. Previously, additional circuitry has been used to prevent this ringing.

The operation of the circuit shown in FIG. 1 will now be described. To ease understanding, the circuit will firstly be described as though the third secondary winding 16 and charge pump capacitor 17 were omitted and diode 4 is replaced with a short circuit.

Due to the influence of the resonant circuit formed by inductor 11 and capacitor 12 (in parallel with capacitor 13 when diodes 4 and 5 are conducting), the voltage across lamp 14 is sinusoidal. The charge pump input capacitor 13 may therefore be considered to be in series with a high-frequency voltage source to pump energy from the A.C. mains and discharge it into the reservoir capacitor 7.

When the lamp voltage is at a positive peak, it will begin to decrease with a sinusoidal form. Because the voltage on charge pump input capacitor 13 cannot change rapidly, diode 6 becomes reverse biased and the voltage at the junction of diodes 5 and 6 decreases, following the sinusoidal waveform of the lamp voltage. The voltage across charge pump input capacitor 13 because no current flows through it as both diodes 5 and 6 are reverse biased.

This continues until the voltage at the junction of diodes 5 and 6 equals the voltage provided from bridge rectifier 1. At this point, diode 5 becomes forward biased and the voltage at the junction of diodes 5 and 6 is clamped to the voltage provided from bridge rectifier 1. The lamp voltage continues to decrease and therefore the voltage across charge pump input capacitor 13 increases. The charge pump input capacitor 13 is absorbing energy from the A.C. mains via the bridge rectifier 1, and the voltage across it peaks at a value equal to the lamp voltage plus the voltage provided from bridge rectifier 1. This coincides with the lamp voltage reaching the negative peak of its sinusoidal waveform.

At this point, diode 5 is reverse biased again. Diode 6 is also reverse biased because the voltage at the junction of diodes 5 and 6 is lower than the voltage on reservoir capacitor 7. Therefore, no current flows through charge pump input capacitor 13, and the voltage across it remains constant. However, the voltage at the junction of diodes 5 and 6 is continuously increasing as the lamp voltage has begun to increase again, having passed the negative peak.

Eventually, the voltage at the junction of diodes 5 and 6 reaches the same voltage as the reservoir capacitor 7 and diode 6 is forward biased. The voltage at the junction of diodes 5 and 6 is then clamped to the voltage on the reservoir capacitor 7. Charge pump input capacitor 13 is caused to discharge its stored energy into reservoir capacitor 7 due to the increasing lamp voltage. This continues until the lamp voltage reaches a positive peak again when the diode 6 is reverse biased again and the next cycle proceeds as described above.

The effect of reintroducing third secondary winding 16, capacitor 17 and diode 4 will now be described. Since third secondary winding 16 forms a transformer with inductor 11, the current flowing through lamp 14 will cause a voltage to be generated across third secondary winding 16. This voltage is used to charge up charge pump capacitor 17 and causes the potential at the junction between diodes 4 and 5 to increase. In effect, this augments the voltage provided by the bridge rectifier 1, and the charge pump input capacitor 13 is charged by a charging voltage that is higher than the voltage provided by the bridge rectifier 1 alone and that increases with the augmented voltage. Thus, the current drawn from the A.C. mains through the bridge rectifier 1 will be increased as the augmented voltage increases.

It is quite common in electronic ballasts for CFLs to provide a third secondary winding for the purpose of detecting an end-of-life condition of the lamp, and this invention can make use of this winding as described above.

It is preferable if the voltage generated by the third secondary winding 16 is in phase or exactly out of phase (or at least as close as possible to either of these conditions) with the voltage across the lamp. If they are in phase then additional current is drawn by the two capacitors 13 and 17 acting in parallel, which helps to mitigate the ringing mentioned above. If they are out of phase then the voltage across capacitor 13 is enhanced.

Figure 2:
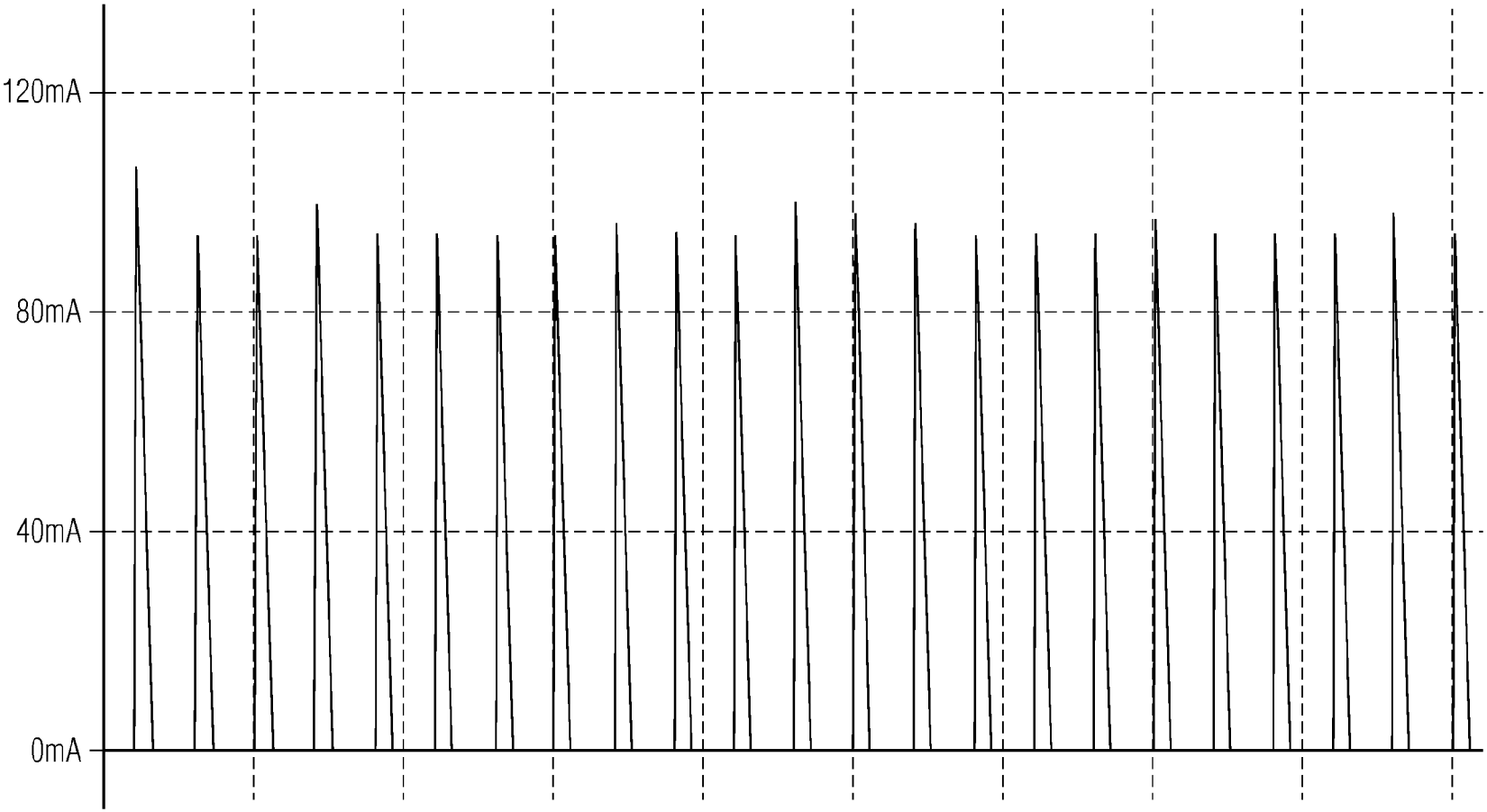
FIG. 2 shows the current drawn by the circuit of the first embodiment.

FIG. 2 shows the pulses of current that will be drawn through bridge rectifier 1 by the circuit of FIG. 1 when the A.C. mains is at 40V, the lamp voltage is 100V rms and the third secondary winding 16 generates a voltage of 30V. Due to the smoothing action of the inductor 2 and capacitors 3*a*, 3*b*, this appears to be a D.C. current of 15 mA drawn through the mains, which is adequate to maintain conduction in the type of dimmer used for lighting applications. Without the third secondary coil 16, capacitor 17 and diode 4, the D.C. current seen by the dimmer would be around 9 mA, which is lower than the holding current of a typical TRIAC.

Figure 3:
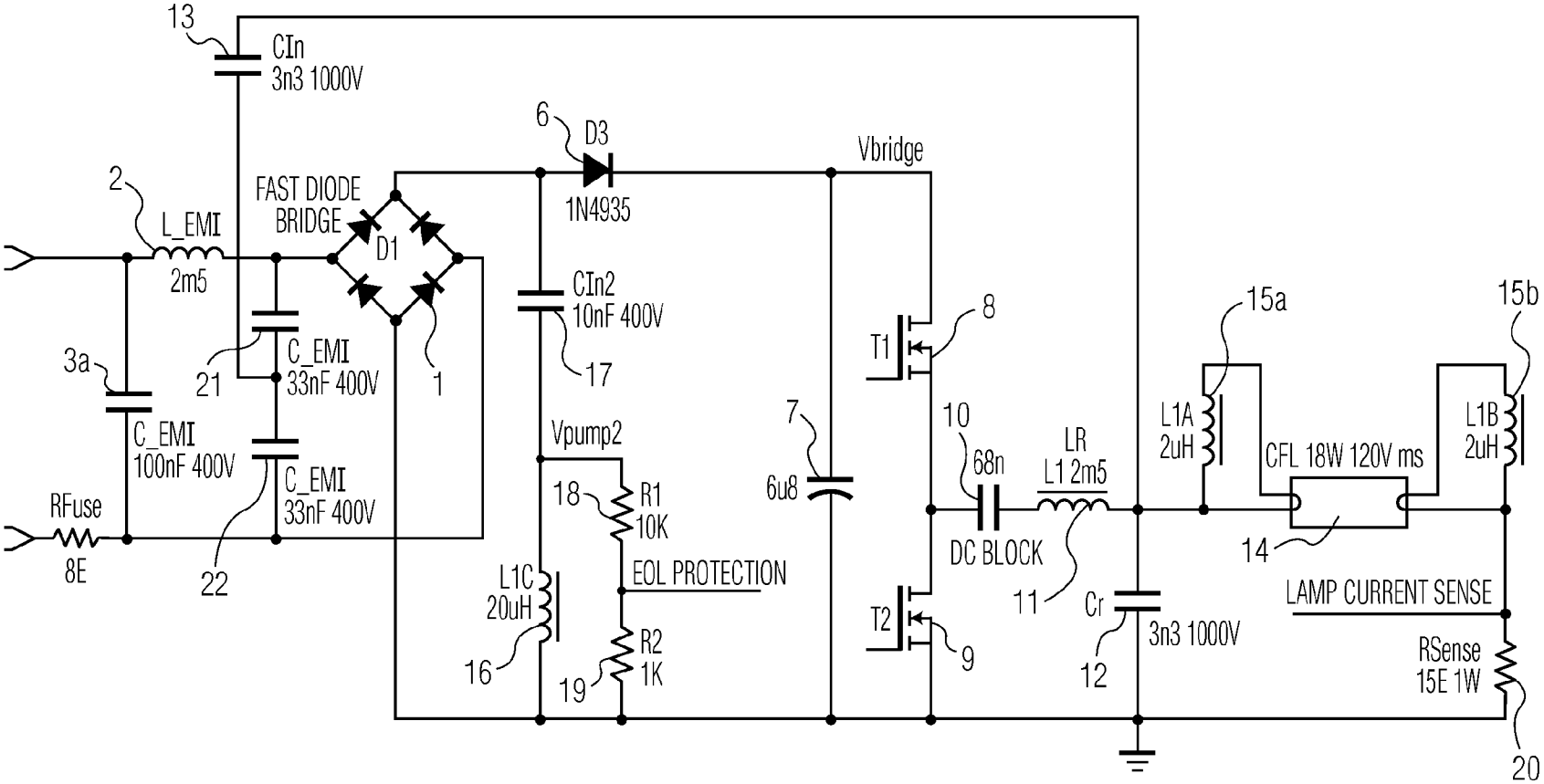
FIG. 3 shows a circuit diagram of a second embodiment of an electronic ballast according to the invention.

FIG. 3 shows a second embodiment, which behaves the same as the first embodiment. Again, this is very similar to the first embodiment with the exception that the charge pump input capacitor 13 is coupled to the junction of a pair of series capacitors 21, 22 connected across the input to the bridge rectifier 1. Diodes 4 and 5 of the first embodiment are no longer needed. In a variant of this embodiment, the connections of capacitors 13 and 17 are reversed (i.e. capacitor 17 is connected to the junction of capacitors 21, 22 and capacitor 13 is connected to the anode of diode 4).

In this embodiment, the inductor 2 turns the spikes of current pumped through capacitor 13 into a steady DC current. As the lamp voltage increases, the current pumped through capacitor 13 can only pass through the diodes of bridge rectifier 1 towards diode 6 and reservoir capacitor 7. Preferably, the values of capacitors 21, 22 are higher than the value of capacitor 13.

Figure 4:
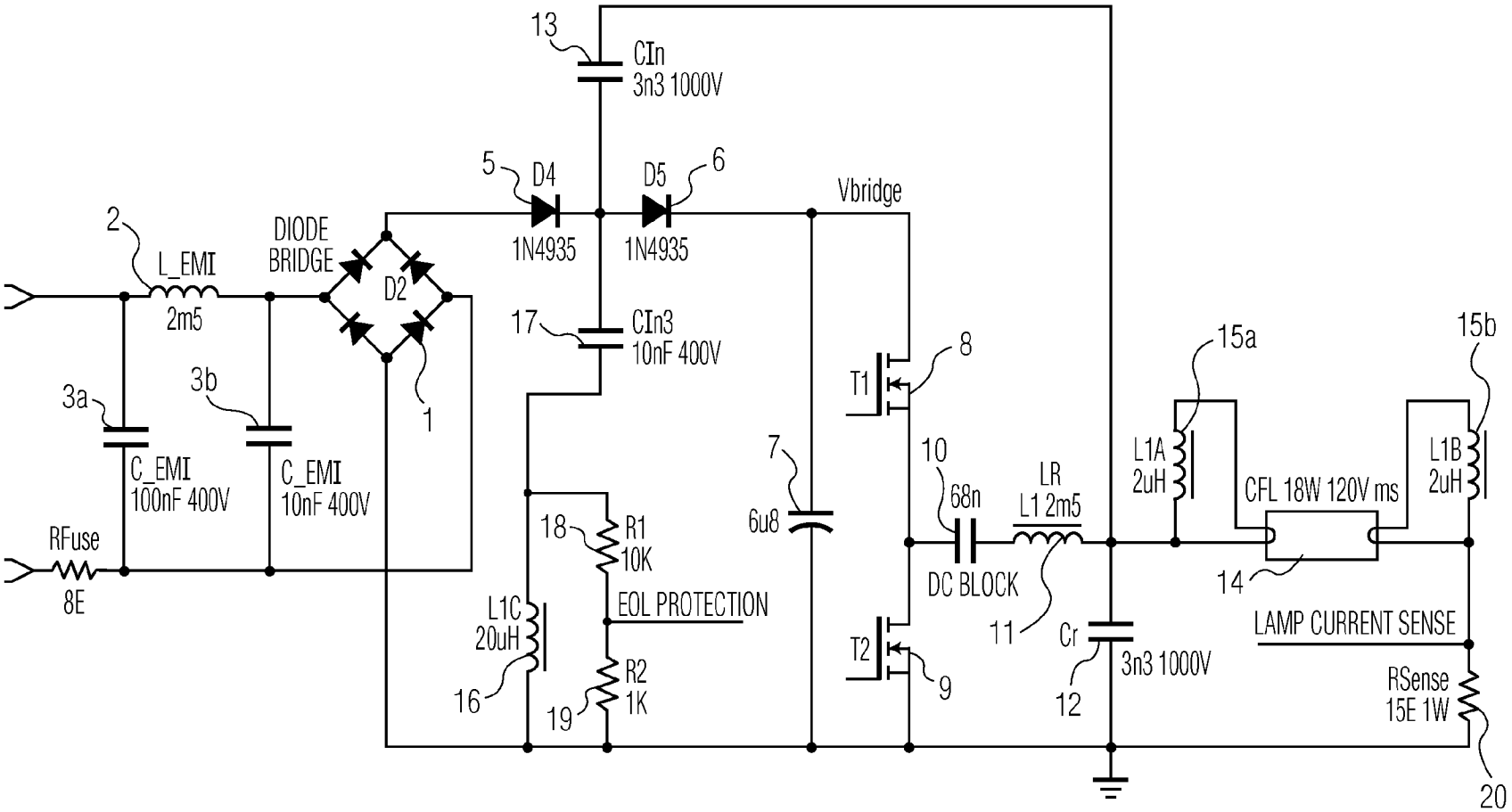
FIG. 4 shows a circuit diagram of a third embodiment of an electronic ballast according to the invention.

FIG. 4 shows a third embodiment, which is almost identical to the first embodiment except that both capacitors 13 and 17 are connected to the same node at the junction of diodes 5 and 6. This works to augment the voltage pumped into the reservoir capacitor 7 by capacitor 13. The advantage of this embodiment is that diode 4 is no longer required.

Figure 5:
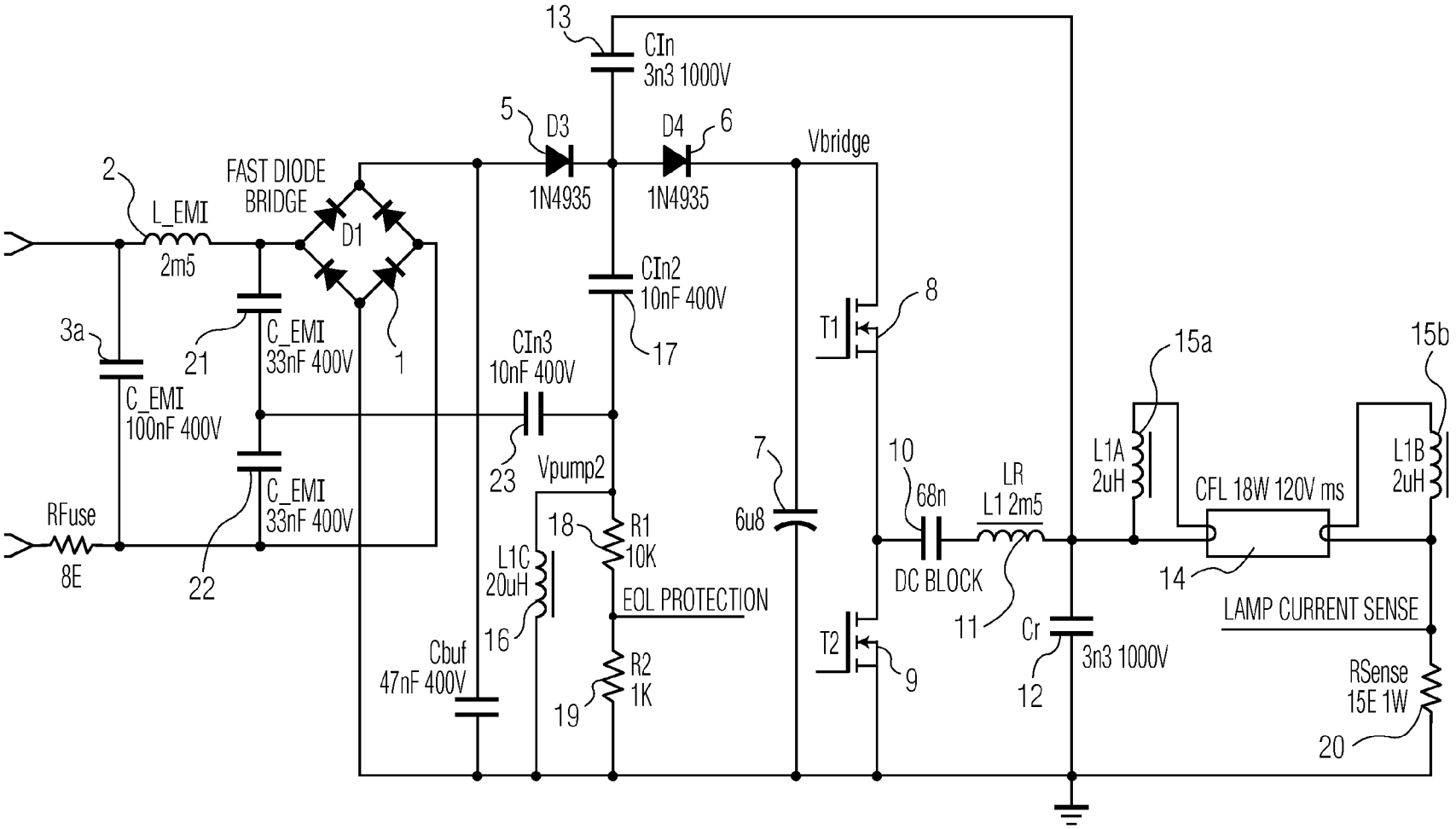
FIG. 5 shows a circuit diagram of a fourth embodiment of an electronic ballast according to the invention.

The fourth embodiment of FIG. 5 is very similar to the third embodiment. The only difference is that the third secondary winding 16 is coupled via a capacitor 23 to the junction between capacitors 21 and 22 as well as to the junction between diodes 5 and 6. An additional reservoir capacitor 31 coupled across the output from bridge rectifier 1 is also provided.

In this embodiment, capacitor 23 pumps current from the third secondary winding 16 through the diodes of bridge rectifier 1 into reservoir capacitor 31. Preferably, the amount of current pumped by capacitor 23 should be at least as large as the current drawn by charge pump capacitor 13.

Figure 6:
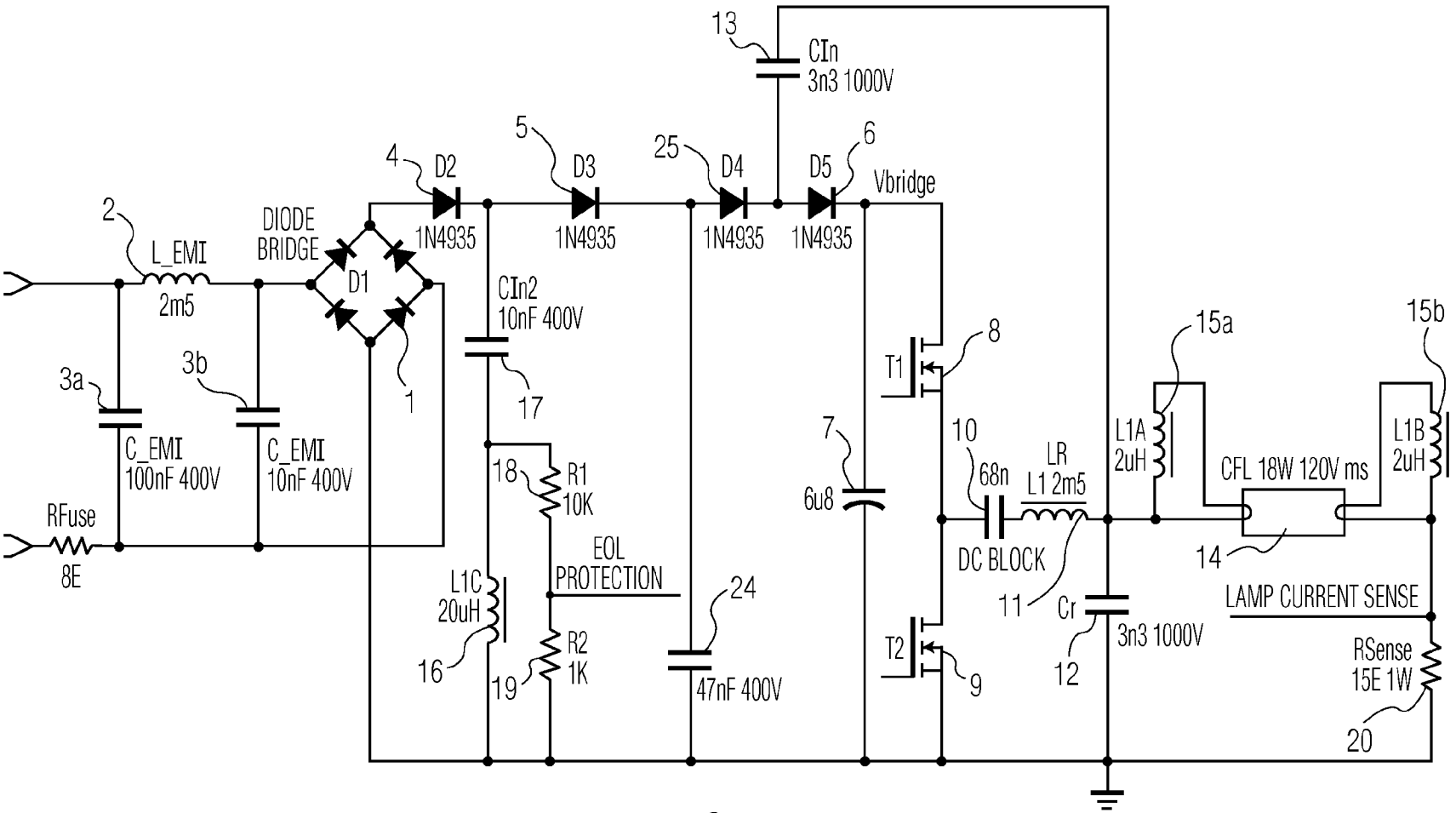
FIG. 6 shows a circuit diagram of a fifth embodiment of an electronic ballast according to the invention.

In FIG. 6, a fifth embodiment is shown. This is based on the first embodiment but includes an additional reservoir capacitor 24 and diode 25. The charge pump input capacitor 13 then draws its charge from this reservoir capacitor 24 through diode 25. This works well when the phase of the voltage generated by third secondary winding 16 and the lamp voltage are not exactly in phase or out of phase with each other.

In a variant of this embodiment, the capacitor 13 is coupled to the junction between diodes 4 and 5 and capacitor 17 is coupled to the junction between diodes 25 and 6. This variant should be used if capacitor 13 will draw more current than capacitor 17; otherwise, the circuit of FIG. 6 should be used as shown. Indeed, this reversal of the connection of capacitors 13 and 17 can be made in all embodiments (where both these capacitors are present), with the capacitor 13, 17 that draws the most current preferably being closest to the bridge rectifier 1.

Figure 7:
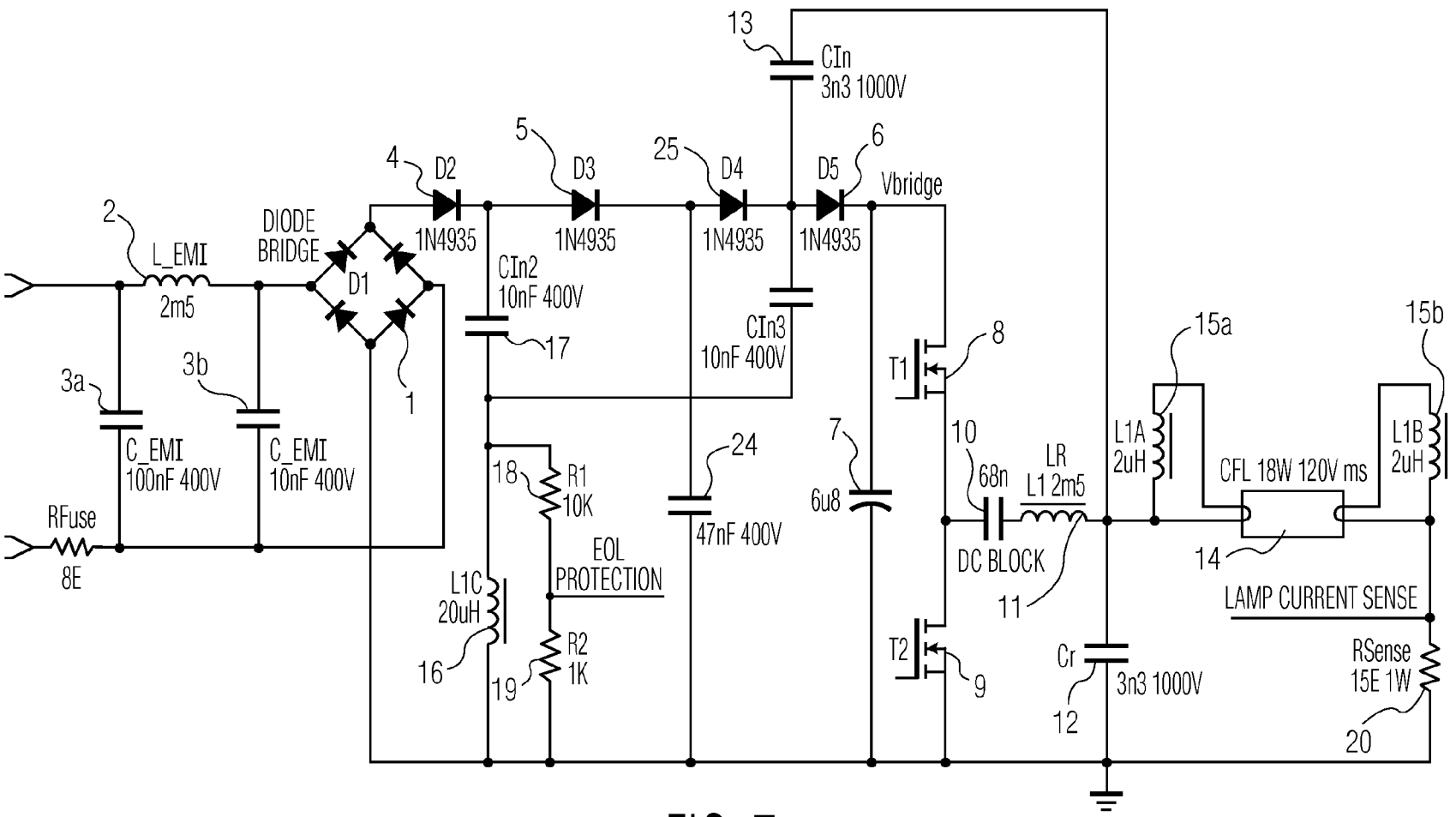
FIG. 7 shows a circuit diagram of a sixth embodiment of an electronic ballast according to the invention.

FIG. 7 shows a sixth embodiment. This is the same as the fifth embodiment except that an additional charge pump capacitor 26 is coupled from the third secondary winding 16 to the junction between diodes 25 and 6. This helps to draw extra current from the mains via the bridge rectifier 1.

Figure 8:
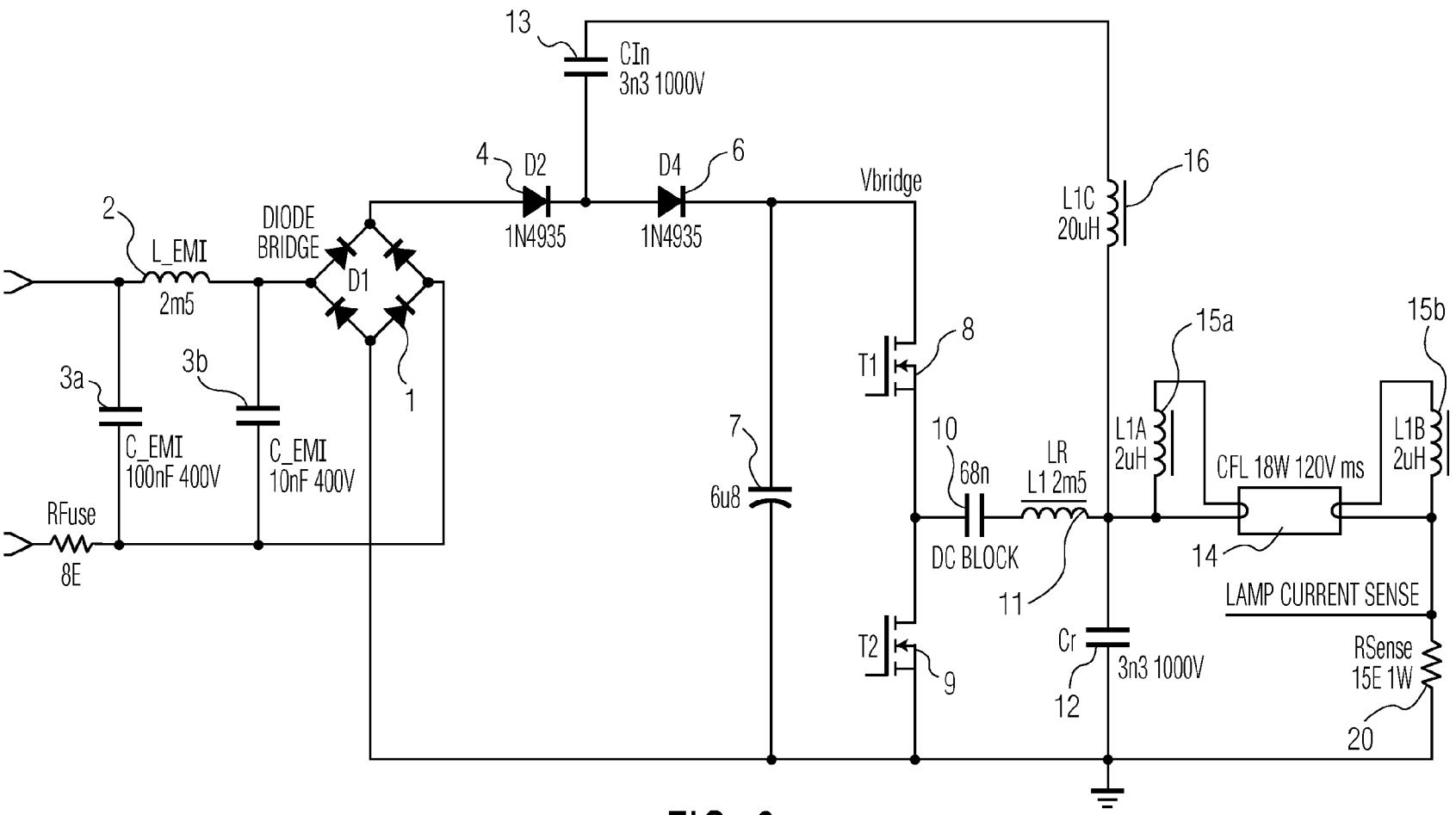
FIG. 8 shows a circuit diagram of a seventh embodiment of an electronic ballast according to the invention.
Figure 9:
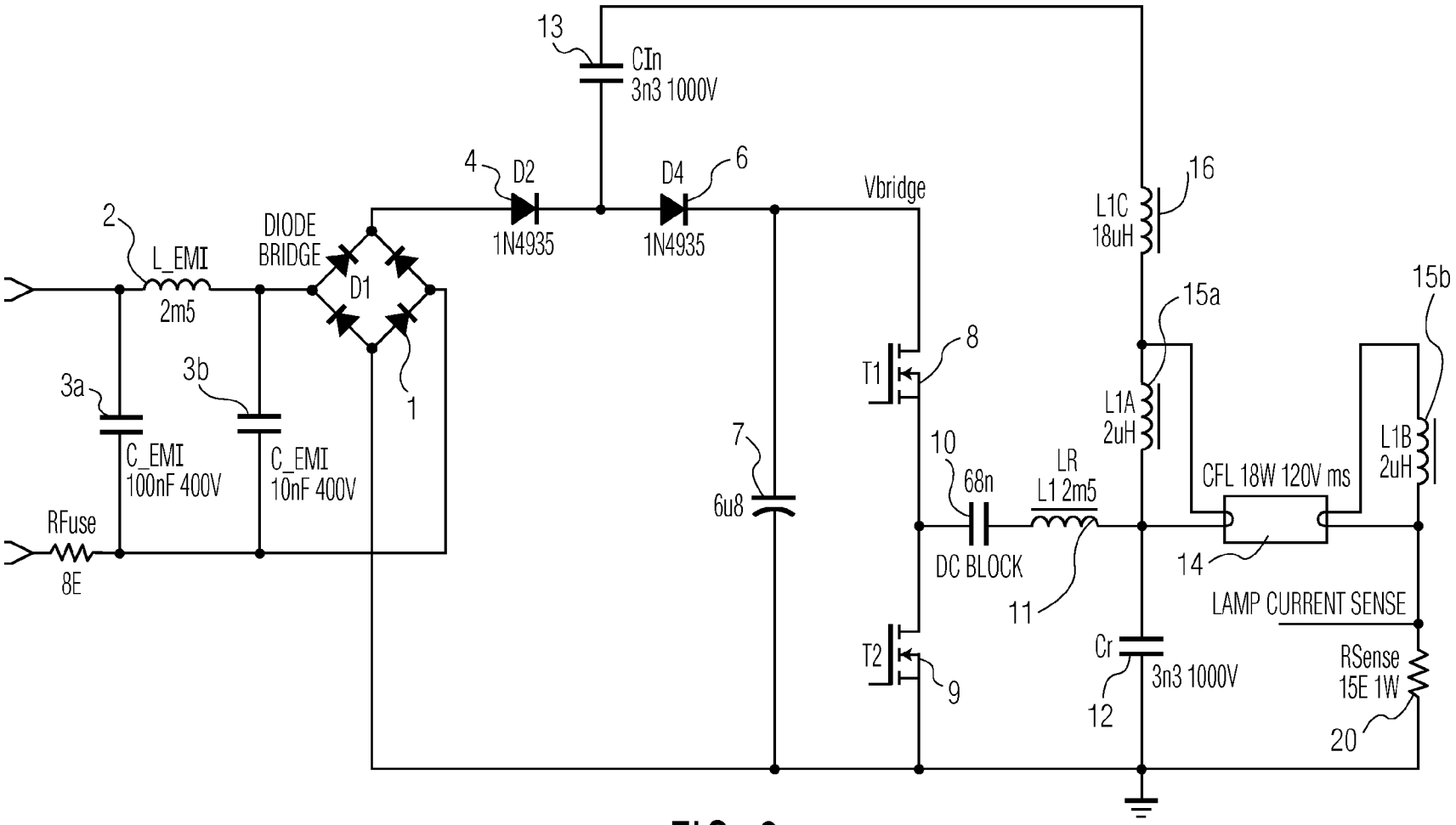
FIG. 9 shows a circuit diagram of an eighth embodiment of an electronic ballast according to the invention.

FIGS. 8 and 9 show seventh and eighth embodiments. These do not include the second charge pump based around third secondary winding 16 and capacitor 17 (and the associated diodes). Instead, the third secondary winding 16 is connected from the junction of coil 11 and capacitor 12 (in the case of FIG. 8) or from secondary winding 15*a* (in the case of FIG. 9) to capacitor 13. Thus, the voltage across third secondary winding 16 is added to the lamp voltage (in the case of FIG. 8) or the lamp voltage and the voltage across secondary winding 15*a* (in the case of FIG. 9). This increases the peak-to-peak voltage applied to capacitor 13. In other words, the charging voltage across capacitor 13 is increased, thereby increasing the current drawn from the mains during the charge pump operation. This can be helpful if the lamp voltage is low as the peak-to-peak voltage across capacitor 13 needs to be greater than the voltage across capacitor 7 for the charge pump to draw current as the mains voltage crosses through 0 volts.

Figure 10:
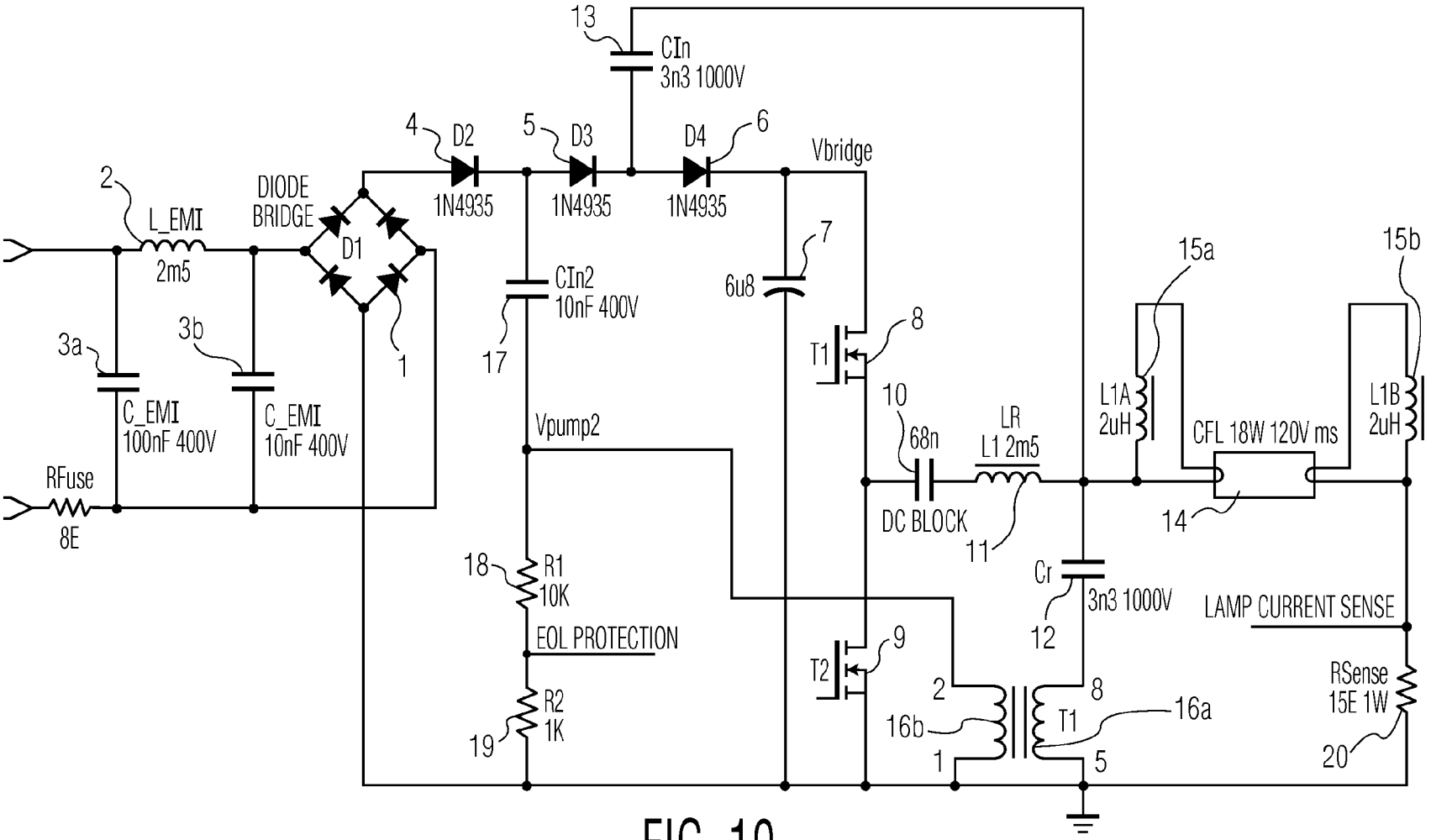
FIG. 10 shows a circuit diagram of a ninth embodiment of an electronic ballast according to the invention.

FIG. 10 shows a ninth embodiment. This is very similar to the first embodiment with the exception that the third secondary coil 16 is replaced by a transformer having a primary winding 16*a* and a secondary winding 16*b*. The secondary winding 16*b* is coupled in place of the third secondary winding 16 of the first embodiment. Primary winding 16*a* is coupled from the junction of coil 11 and capacitor 12 to a ground terminal. Primary winding 16*a* is therefore energised by the alternating voltage generated in the resonant circuit of coil 11 and capacitor 12.

Figure 11:
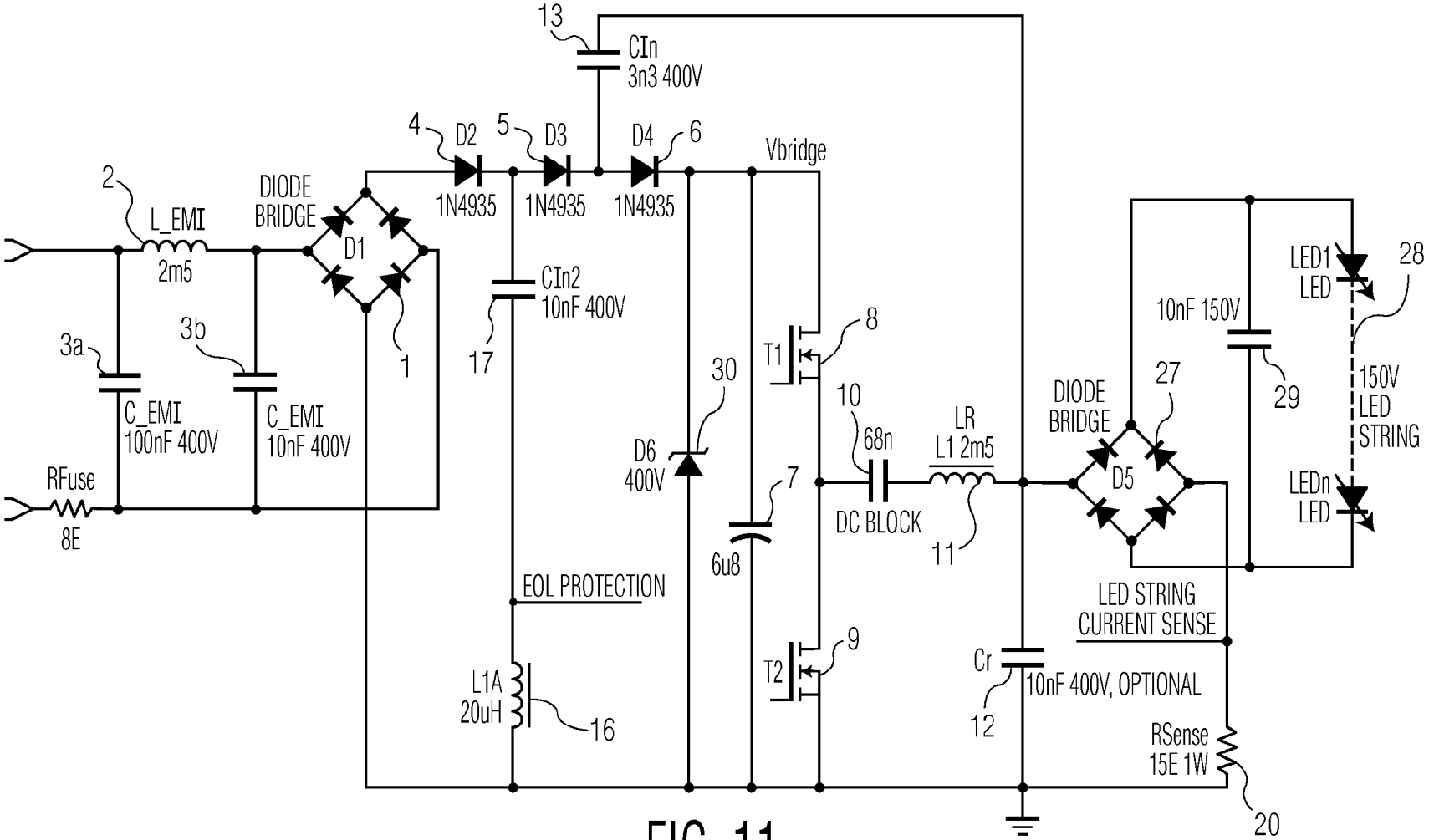
FIG. 11 shows a circuit diagram of a tenth embodiment of an electronic ballast according to the invention.

FIG. 11 shows a tenth embodiment in which the CFL of the previous embodiments is replaced by an assembly of LEDs in series. In particular, the alternating voltage generated by the resonant circuit of coil 11 and capacitor 12 is coupled to a bridge rectifier 27, which rectifies the alternating voltage to a direct current for energising a series array of LEDs 28. The combined forward voltage of all the LEDs in the series array of LEDs 28 is typically in the region of 150V when used with 230V mains, but lower forward voltages may be used with 120V mains. A capacitor 29 is connected in parallel with the series array of LEDs 28. Capacitor 29 ensures that the current flowing through the series array of LEDs remains substantially constant.

A zener diode 30 is coupled across reservoir capacitor 7 to prevent the voltage across this rising too high in the event of "overpumping", which can occur when high levels of dimming are applied. This "overpumping" can occur when used with arrays of LEDs (unlike CFLs, which always require a small amount of power to heat the electrodes even at very deep dimming levels), and a bleeder resistor can be used to dissipate the excess energy as heat.

It is possible to remove capacitor 12 from the resonant circuit as it is no longer necessary to generate the high voltages required to ignite a CFL. However, it is beneficial to retain capacitor 12 to assist with pumping current from the mains using capacitor 13, especially if an array of LEDs with a high combined forward voltage are used.

Figure 12:
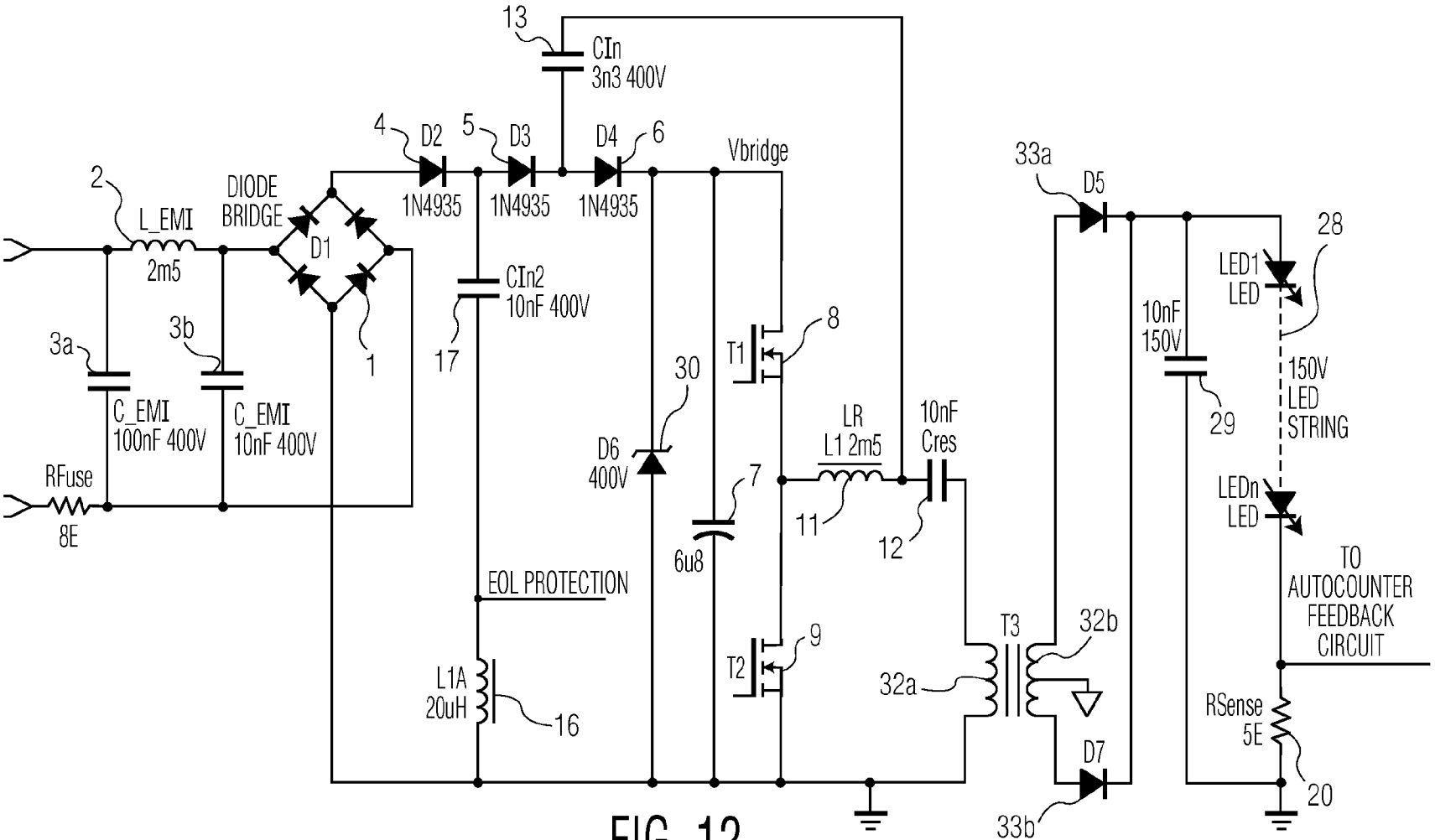
FIG. 12 shows a circuit diagram of an eleventh embodiment of an electronic ballast according to the invention.

FIG. 12 shows an eleventh embodiment. This is very similar to the tenth embodiment, except that a transformer comprising primary 32*a* and secondary windings 32*b* is used to couple the array of LEDs 28 to the electronic ballast. The primary winding is coupled in series with capacitor 12. The secondary winding 32*b* is centre-tapped and each end of the winding drives a respective diode 33*a*, 33*b*, which together form a full-wave rectifier for driving the array of LEDs with DC voltage. This embodiment is particularly useful with arrays of LEDs that have a relatively low or high forward voltage as the transformer turns ratio can raise of lower the voltage across secondary winding 32*b* appropriately. It also has the advantage of providing galvanic isolation between the ballast and the lamp, and indeed transformer coupling can be used with any of the other embodiments (which all use CFLs) if this isolation is required. In this embodiment, the resistor 20 for monitoring the current through the lamp is placed in series with the array of diodes 28; feedback is provided from this resistor to the electronic ballast using an opto-coupler or a transformer.

In a variant of this embodiment, the capacitor 13 is connected to the junction between inductor 11 and primary winding 32*a* rather than to the junction between capacitor 10 and inductor 11. This has the advantage of reducing the capacitive load on the half-bridge formed by transistors 8, 9, but does reduce the voltage swing available across primary winding 32*a*.

The charge pump principle described in the above embodiments can also be used with other types of converter, such as flyback and buck converters. In these cases, the charge pump capacitors are driven by secondary windings on the transformers within such converters. These are particularly beneficial when used with the LED lamp embodiments of FIGS. 11 and 12 as they can improve the efficiency by removing the need to dissipate any "overpumped" energy in a bleeder as discussed above.

Other variations to the disclosed embodiments can be understood and effected by those skilled in the art in practising the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. Any reference signs in the claims should not be construed as limiting the scope.

The invention claimed is:

1. An electronic ballast for lighting applications, the electronic ballast comprising:

a first charge pump having an input capacitor charged with a supply current drawn from a power source by application of a charging voltage to the input capacitor, a magnitude of the supply current being proportional to a magnitude of the charging voltage; and a voltage booster for generating a boost voltage, which is used to augment the charging voltage, thereby increasing the current drawn from the power source, wherein the voltage booster comprises a secondary winding of a transformer configured to generate the boost voltage, wherein a primary winding of the transformer is energised by a source of alternating voltage generated within the electronic ballast, wherein the secondary winding is coupled to an anode of a diode via a second capacitor, and wherein a cathode of the diode is connected to the input capacitor.

2. An electronic ballast according to claim 1, the electronic ballast being coupled to the power source by a bridge rectifier, which produces a supply voltage for the electronic ballast.

3. An electronic ballast according to claim 2, wherein a first terminal of the input capacitor is coupled to the bridge rectifier such that the charging voltage increases with the supply voltage.

4. An electronic ballast according to claim 2, further comprising an electromagnetic interference (EMI) filter coupling the power source to the bridge rectifier.

5. An electronic ballast according to claim 4, wherein the EMI filter comprises a pair of filter capacitors in series between input terminals of the bridge rectifier, a first terminal of the input capacitor being coupled to a junction of the filter capacitors.

6. An electronic ballast according to claim 1 wherein a second terminal of the input capacitor is coupled to a source of alternating voltage generated within the ballast.

7. An electronic ballast according to claim 6, wherein the lighting application comprises one of a compact fluorescent lamp (CFL) and an assembly of LEDs in series.

8. An electronic ballast according to claim 1, further comprising a second charge pump adapted to increase the voltage at a first terminal of the input capacitor.

9. An electronic ballast according to claim 8, wherein the second charge pump comprises a second charge pump input capacitor.

10. A method for controlling current drawn by an electronic ballast for lighting applications from a power source, the method comprising:

charging an input capacitor in a first charge pump with a supply current drawn from a power source by application of a charging voltage to the input capacitor, a magnitude of the supply current being proportional to a magnitude of the charging voltage; and generating a boost voltage, which is used to augment the charging voltage, thereby increasing the current drawn from the power source, wherein the boost voltage is generated by a secondary winding of a transformer, a primary winding of which is energised by a source of alternating voltage generated within the electronic ballast for driving a lamp, wherein the secondary winding is coupled to an anode of a diode via a second capacitor, and wherein a cathode of the diode is connected to the input capacitor.

11. A method according to claim 10, wherein the boost voltage is used to augment the charging voltage by increasing the voltage at one of a first and a second terminal of the input capacitor.

* * * * *